US005621370A

United States Patent [19]

St. Louis

[11] Patent Number: 5,621,370

[45] Date of Patent: Apr. 15, 1997

[54] MOUNTING ARRANGEMENT FOR THERMOSTAT IN A CLOTHES DRYER

[76] Inventor: Robert St. Louis, 8980 Rochette, St. Leonard, Quebec, Canada, H1P 2K2

[21] Appl. No.: 403,403

[22] Filed: Mar. 14, 1995

[51] Int. Cl.[6] ..... H01H 37/04

[52] U.S. Cl. ..... 337/380; 248/27.1

[58] Field of Search ..... 337/304, 327, 337/372, 398, 380, 298; 34/524; D32/58.8; 248/27.1; 312/228, 257.1, 263

[56] References Cited

U.S. PATENT DOCUMENTS

| | | | |
|---|---|---|---|
| 3,858,140 | 12/1974 | Hancock | 337/88 |
| 4,282,506 | 8/1981 | Satterlee | 337/380 |
| 4,297,668 | 10/1981 | Place | 337/365 |
| 4,626,821 | 12/1986 | Uersaw | 337/380 |
| 4,649,712 | 3/1987 | Tate, Jr. et al. | 62/137 |
| 4,653,708 | 3/1987 | Rich | 248/27.1 |
| 5,350,140 | 9/1994 | Ripley et al. | 248/27.1 |

FOREIGN PATENT DOCUMENTS

| | | |
|---|---|---|
| 1271043 | 7/1990 | Canada . |
| 2110303 | 11/1993 | Canada . |

*Primary Examiner*—Leo P. Picard
*Assistant Examiner*—Jayprakash N. Gandhi

[57] ABSTRACT

This invention relates to a thermostat mounting arrangement suitable for use in a clothes dryer. Thermostat mounting arrangement includes a thermostat mounted to engage the inner and outer opposing sides of a surface supporting portion of the clothes dryer to sense temperature conditions in the clothes dryer. The mounting arrangement is characterized by an aperture passing through the surface supporting portion. The aperture has an enlarged central opening with four projection tab members extending into the central opening and two diametrically opposed slots extending radially outward from the central opening. The thermostat includes a temperature sensitive flat surface adapted for positioning within the central opening of the aperture slightly beyond the inner surface of the surface supporting portion of the clothes dryer. The thermostat has two resilient wings each having an arm extending generally toward and through a corresponding slot of the aperture. Each arm terminates in a bent end member adapted to engage the inner side of the surface portion adjacent the slot of the aperture. The thermostat has a depressed shoulder surrounding the temperature sensitive flat surface which engages the outer side of the projection tab members extending into the central opening of the aperture.

17 Claims, 3 Drawing Sheets

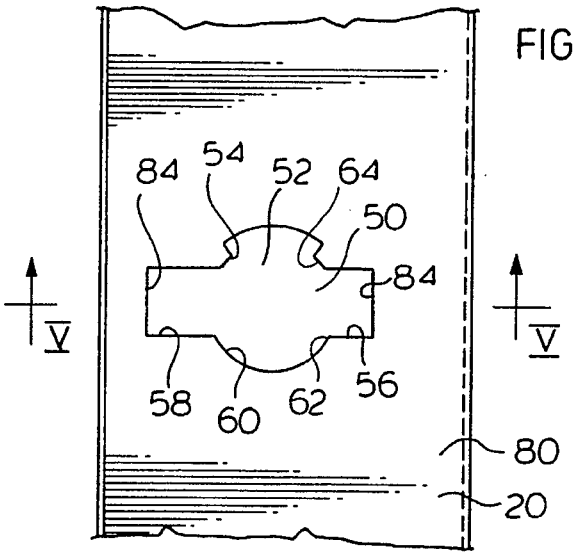
FIG. 4.
FIG. 5.
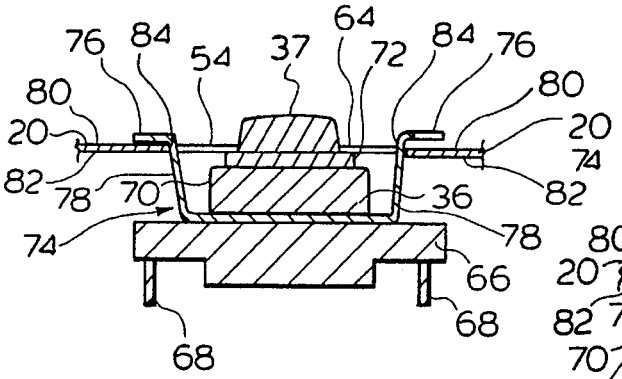
FIG. 6.
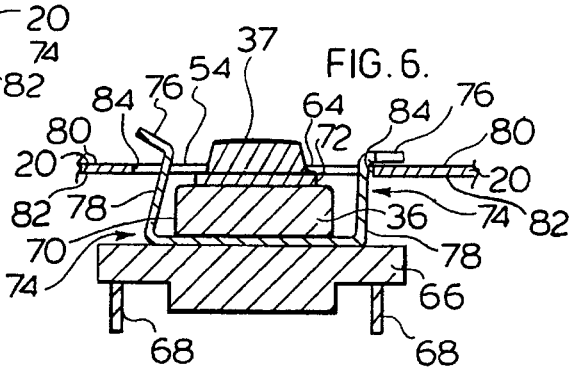
FIG. 7.
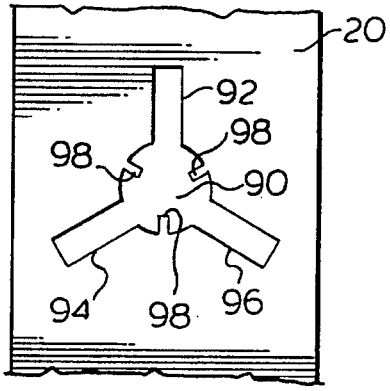

MOUNTING ARRANGEMENT FOR THERMOSTAT IN A CLOTHES DRYER

FIELD OF THE INVENTION

The present invention relates to thermostat mountings and, in particular to mountings of thermostats in appliances, such as clothes dryers.

BACKGROUND OF THE INVENTION

In clothes dryers it is usual practice to mount a number of temperature sensitive devices, such as thermostats, in strategic places in the air flow path to constantly monitor the temperature of the air stream at each strategic location to control the amount of electric energy used by heating elements in the electric dryer or gas used by a burner in a gas dryer.

Typically, there are two varieties of thermostat designs which are used in dryers and other appliances. One type of thermostat is referred to as the air stream type where the sensing bulb of the thermostat includes a reacting disc provided on a leading surface of the bulb that protrudes about 9 mm inside the surface on which the thermostat is mounted. Another typical thermostat is a surface mount type wherein the bulb sits outside the surface on which it is mounted and the reacting disc flush against to the surface which it is sensing. Both these types of thermostats are usually mounted by means of screws. However, the problem with using screws is that the screws require assembly. Further, when the screws are tightened they sometimes push the legs of the thermostat out of position lifting the reacting disc face away from the surface. Consequently, this effects operation of the thermostat. Further, for the purposes of servicing, having to remove the screws may be a difficult task.

The difficulty with the air stream type of thermostat is that in certain applications it protrudes a relatively large distance into the air stream and requires a high temperature setting level. Accordingly, it would be beneficial to develop a generally flush mounted thermostat with the reacting disc of the bulb type thermostat protruding a small distance such as about 2 mm, for example, into the air stream. It would be further advantageous to provide a thermostat which may be mounted to a mounting surface without the use of screws and can be easily removed for servicing.

Two thermostat mountings which have been developed in the past without the use of screws are shown in U.S. Pat. No. 4,297,668 issued Oct. 28, 1981 to Donald E. Place and U.S. Pat. No. 4,649,712 issued Mar. 17, 1987 to Ralph Tate, Jr. et al. U.S. Pat. No. 4,297,668 teaches the use of a bracket having a pair of legs which surround a tubular type member and a second pair of legs which grasp the sides of the thermostat such that the reacting disc of the thermostat is placed in contact with a surface of the bracket which lies against the tubular structure. U.S. Pat. No. 4,649,712 shows the mounting of a bulb type thermostat in the recess of a ice making appliance. The thermostat is mounted in interference fit with the recess by the use of a pair of spring clips having a serpentine cross-sectional shape. The arrangement allows for the reacting disc of the thermostat to protrude slightly into the air stream. The problem associated with this device is that the interference fit would appear to make it difficult to remove the thermostat from the recess.

SUMMARY OF THE INVENTION

In accordance with an aspect of the present invention there is provided a thermostat mounting arrangement in an apparatus having a surface supporting portion with first and second opposing sides. The thermostat is mounted to engage the first and second opposing sides of the surface supporting portion to sense temperature conditions in the apparatus. The mounting arrangement comprises an aperture passing through the surface supporting portion. The aperture has an enlarged central opening with projection members extending into the central opening and at least two slots extending radially outward from the central opening of the aperture. The mounting arrangement further comprises the thermostat. The thermostat includes a temperature sensitive surface portion adapted for positioning within the central opening of the aperture and at least two resilient wings each having an arm portion extending generally toward and through a corresponding slot of the aperture. Each wing arm portion terminates in a bent end portion adapted to engage the first side of the surface portion adjacent the slot of the aperture. The thermostat is adapted to engage the second side of the projection members extending into the central opening of the aperture.

The thermostat mounting arrangement of the present invention permits for the mounting of the thermostat on the surface supporting portion of the apparatus without the use of additional positive fastening means such as, for example, screws.

In accordance with other aspects of the present invention, the temperature sensitive portion of the thermostat may comprises a flat temperature responsive surface that is positioned just beyond the first surface of the supporting portion of the apparatus. The thermostat preferably includes a depressed shoulder surrounding the temperature sensitive flat surface which is engaged by the projection members and allows the temperature sensitive flat surface to protrude slightly beyond the first side and into the apparatus.

Preferably, the aperture comprises two diametrically opposed slots. Alternatively, the aperture may comprise more than two slots displaced about the central opening of the aperture. Further, the projection member may comprise a tab member having its second side engaging the thermostat.

The assembly of the thermostat into the aperture is a simple operation requiring possibly only the use of a screw driver. To assemble the thermostat in the aperture one of the wing arms is bent inwardly toward the main body or bulb of the thermostat. The thermostat is slightly angled so that the other non-bent arm may be inserted in a first slot, that is shorter than the opposed second slot, until the bent wing arm rests on the first side of the surface portion. The thermostat is then pivoted about the non-bent wing to push the temperature sensitive portion through the central portion of the aperture. During this pivoting motion, the bent wing arm is pushed through the other slot. Thereafter, the bent wing arm is re-straightened outwardly such that the wing arms engage edges of the aperture to secure the thermostat to the surface support portion of the apparatus.

Further it is envisaged that the slots extend in an orthogonal direction to the general direction of air flow over the thermostat temperature sensitive surface. This minimizes the effects of cooler air flow into the apparatus from the relatively large air gaps provided by these slot in close proximity to the temperature sensitive surface. Further, air gaps may be provided between the thermostat and the central opening of the aperture. The air gaps on an upstream air flow side of the thermostat are smaller than those on a downstream air flow side of the thermostat. This permits for possibly cooler air to enter the apparatus induced by the air flow stream passing over the thermostat. The size of these apertures can be adjusted to bias operation of the thermostat.

BRIEF DESCRIPTION OF THE DRAWINGS

For a better understanding of the nature and objects of the present invention, reference may be made to the accompanying diagrammatic drawings in which:

FIG. 4 is an enlarged front view of the preferred aperture of the present invention;

FIG. 5 is a partial sectional view of the thermostat mounted within the aperture of the diffuser as shown along lines V—V of FIG. 4;

FIG. 6 is a partial sectional view of the thermostat partially positioned within the aperture of the diffuser as shown along lines V—V of FIG. 4; and, FIG. 7 is an enlarged view showing an alternate embodiment for the aperture used in the surrounding wall of the diffuser used to mount the thermostat.

DETAILED DESCRIPTION OF THE INVENTION

Figure 1:
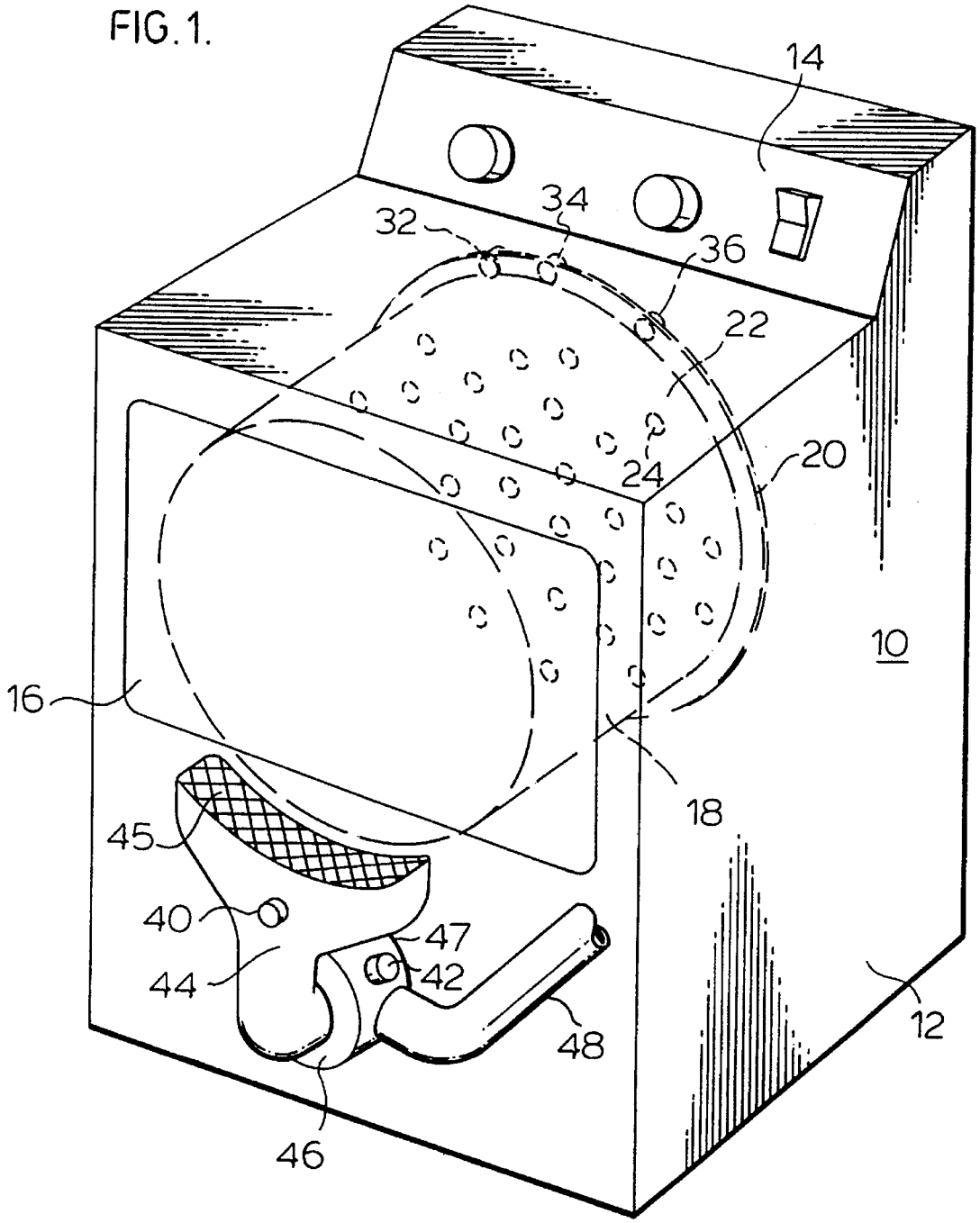
FIG. 1 is a perspective view of an electric clothes dryer.

Referring to FIG. 1, a domestic clothes dryer 10 is shown. While the present invention has application with other heat sensing apparatus and appliances, such as, for example, furnaces, description of the preferred embodiment has been limited to a clothes dryer.

Dryer 10 has a cabinet or housing 12 on which is mounted a control panel 14 which allows the user to select various drying modes and degrees of dryness of the clothes undergoing drying. Cabinet 12 has a door 16 mounted on the front panel to allow access to the drum 18. Drum 18 is mounted in cabinet 12 so as to allow for rotation therein.

Figure 2:
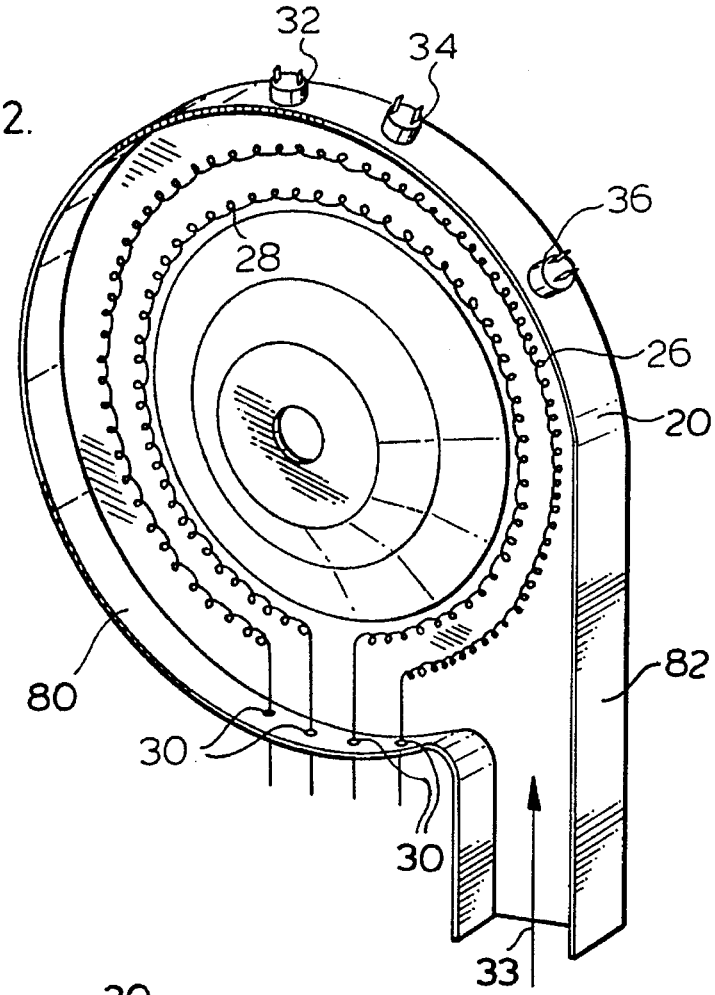
FIG. 2 is a view of the diffuser showing the heating device of the dryer of FIG. 1 and thermostats mounted in the diffuser wall.

Drum 18 is mounted within the cabinet 12 so that the rear of the drum 18 is substantially surrounded by a diffuser 20, shown in more detail in FIG. 2. The drum 18 is provided with a flat disc shaped member 22 at the rear thereof which contains a plurality of apertures such as 24 for the passage of drying air there through.

The diffuser 20 of the dryer 10 provides a convenient method of mounting a pair of electrical heating elements 26 and 28 on insulators mounted in the diffuser. These elements are standard heating elements and in the dryer illustrated, the elements in this instance being capable of separate electrical energization. The elements 26 and 28 pass through insulators such as those shown at 30 in the diffuser 20. The diffuser is made to mate with the revolving drum so that there is good communication between the drum and the diffuser for the hot air steam. It should be understood that while an electric clothes dryer is shown, the invention may be used in gas dryers.

Three thermostats 32, 34 and 36 are shown mounted on the top of the diffuser 20. Two of these thermostats 32 and 34 are designed to open before the temperature of the air entering the clothes drum reaches a point that might damage the clothes being dried. The third temperature sensor 36 has a higher temperature rating and would be generally regarded as an ultimate safety device rather than a controlling device.

Figure 3:
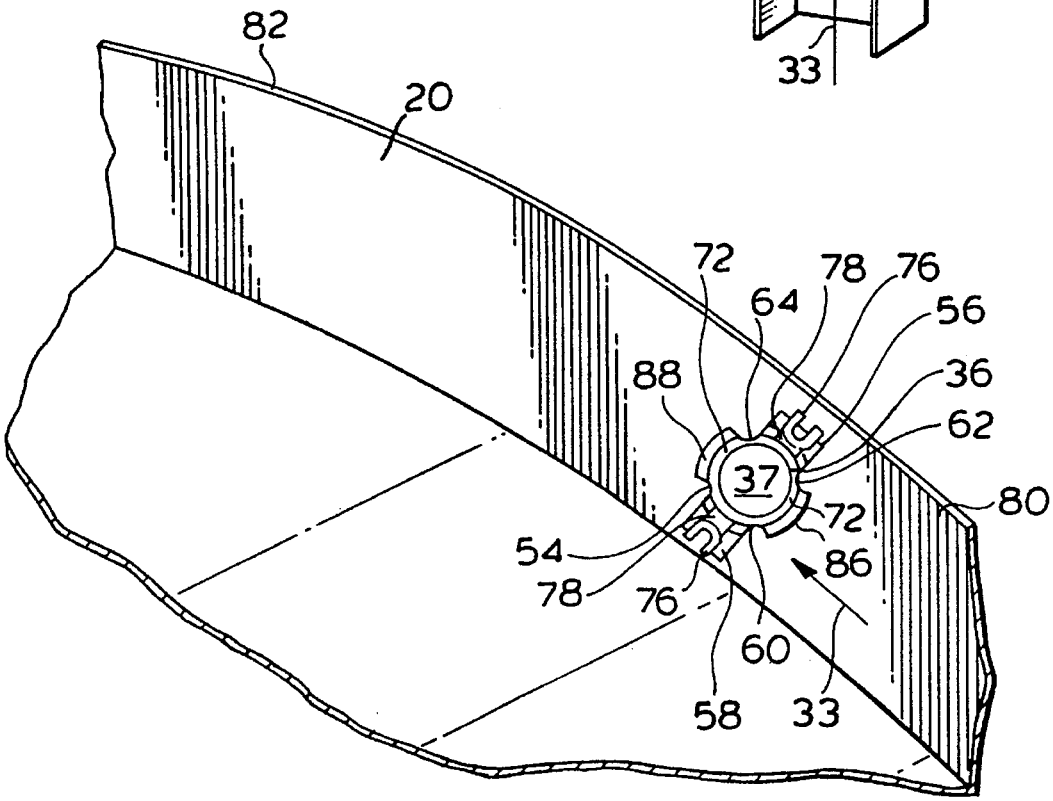
FIG. 3 is an enlarged view showing the aperture in the surrounding wall of the diffuser with the thermostat mounted arrangement of the present invention.

As previously stated, the thermostats 32 and 34 will have operating characteristics and be mounted in a different manner on diffuser 20. Referring to FIGS. 3 and 5, it will be seen that thermostat 36 is mounted in diffuser 20 with the temperature sensitive flat surface or reacting disc 37 exposed completely to the airflow stream in the diffuser. The air flow stream moves in the direction of arrow 33 shown in FIGS. 2 and 3. Preferably the thermostat temperature sensitive flat surface 37 protrudes just beyond the diffuser 20 into the air stream. Preferably "just beyond" means about 2 mm.

Two additional temperature sensors or thermostats are located at or near the front of the cabinet so as to sample the temperature of the air stream as it leaves the rotating drum. These are sensors 40 and 42 which essentially control the drying process. Temperature sensor 42 has a higher temperature activation than sensor 40.

A housing 44 is mounted so as to be in airflow communication with drum 20. A lint filter 45 is shown for trapping lint just as the air enters housing 44. Air is drawn from housing 44 into blower housing 46, the blower being driven by motor 47 and the air leaving blower 46 exits the dryer via pipe or duct 48.

In accordance with the present invention, the thermal mounting arrangement of the clothes dryer is shown for thermostat 36 as it is mounted to the diffuser wall 20 in FIGS. 3 and 5.

FIG. 4 shows a front elevation view of the aperture used in the present invention. The aperture 50 of the present invention comprises a large center opening 52 with four projection tabs 54, 60, 62 and 64 extending into the central opening 52. The aperture 52 further includes two diametrically opposed slots 56 and 58. It is noted that the slot 58 has a slightly longer length than slot 56 and this is provided to facilitate the insertion of the thermostat into aperture 52. With reference to FIG. 3, it can be seen that the slots 56 and 58 extend in a direction radially outward from the center opening 52 and a direction which is orthogonal to the general direction of the air flow stream shown by arrow 33.

Referring to FIG. 5 there is shown a thermostat 36 mounted within the aperture 50 in accordance with the thermostat arrangement of the present invention. Thermostat 36 includes a main body portion 66. Beneath the main body portion 66 are provided two electrical contacts 68 for which the sensing of the temperature determined by the reactive disc 37 of the thermostat can be measured. Thermostat 36 further includes an upper bulb portion 70 having two shoulders for which one shoulder is identified at 72 and above which shoulder 72 extends the temperature sensitive flat surface or reactive disc 37. The thermostat 36 further includes two resilient wings 74 each having an arm 78 extending generally toward and through a corresponding slot of the aperture 50. Each arm terminates in a bent end member 76 which preferably comprises a U shaped flange (see FIG. 3). The wings 74 are referred to as resilient because the wings can be moved relative to the bulb 70 of the thermostat without breaking. The bulb portion 70 is covered by a metal cover that includes a metal portion extending over the reactive disc 37. The wings 74 are also metal that extend from the metal cover.

Referring to FIGS. 3 and 5, the manner in which the thermostat is mounted within the aperture 50 is now described. The diffuser 20 can be said to have a first and second opposing surfaces or inner and outer surfaces 80 and 82. The temperature sensitive flat surface 37 of thermostat 36 projects about 2 mm into the dryer beyond the inner surface 80 of diffuser 20. To hold this surface 37 in this position, the thermostat engages both inner side 80 and outer side 82 of the diffuser. Movement of the thermostat into the air stream 33 is limited by the shoulder 72 located on top of the bulb 70 of the thermostat engaging the outer surface 82 of projections 54, 60, 62, and 64. Movement of the thermostat 36 out of the opening or aperture 50 is prevented by the overlapping engagement of the end portions 76 of the wings 74. The end portions 76 engage the inner side or surface 80 of the diffuser adjacent the ends of the slots 56 and 58.

The assembly of the thermostat 36 within the aperture 50 of the diffuser 20 is simply accomplished by bending or squeezing one of the wing members 74. Referring to FIG. 5, it will be seen that the left most wing member 74 slopes slightly outwardly than the right most wing member 74. During insertion of the thermostat into the aperture 50, the left wing 74 will be squeezed inwardly towards the bulb 70 of the thermostat 36 as shown in FIG. 6. This will allow the end portion 76 of the right wing 74 to be placed in slot 56 such that the right end portion 76 abuts surface 80 adjacent slot 56. The thermostat is then pivoted about this point. The temperature sensitive flat surface 37 will be positioned within the central opening such that the shoulder 72 will abut the protrusions 54, 60, 62, and 64. In this position the squeezed wing 74 passes through slot 58. Next, a flat instrument such as a screwdriver may be pushed downwardly between the left wing 74 and the bulb 70 of the thermostat preying or forcing the arm 78 of the left wing 74 to take on the final position shown in FIG. 5 with the end portion 76 engaging surface 80 adjacent slot 58. In so doing, the arms 78 of the wings 74 engage edges 84 of slots 56 and 58. The present invention provides for relatively easy mounting of the thermostat 36 within the aperture without having to use screws to fasten the thermostat in place.

Referring to FIG. 3, it can be seen that two air gaps are provided between the aperture 52 and the thermostat 36. These air gaps are shown as an upstream air gap 86 and a downstream air gap 88. The upstream air gap 86 is shown to be smaller than the downstream air gap 88. The purpose of the air gaps is to allow for quicker resetting of the thermostat 36 when the temperature in the diffuser cools. For example, in the event that one or more of the heating elements 26 and 28 are turned off, it may be necessary for thermostat 36 to reset itself prior to these heating elements being energized again. Due to the air circulation with the diffuser, the diffuser creates a negative back pressure which draws air in through any opening in the diffuser wall. By providing air gaps 86 and 88, cooler air is allowed to flow in over the temperature sensitive flat surface 37 of thermostat 36. The size of the gaps can be chosen so that the air flowing in during a heating cycle is not sufficient to adversely bias the thermostat 36. However, once the heating elements are de-energized, then air drawn in through these air gaps may help in cooling the thermostat and decreasing the time it takes the thermostat to reset itself. To have the reverse effect the relative sizing of the respective openings or gaps 86 and 88 can be reversed.

The thermostat 36 used in the present invention may comprise a common thermostat known as 69T series internal heater manufactured by Therm-O-Disc, Inc. which is a subsidiary of Emerson Electric of Mansfield, Ohio.

Referring to FIG. 7, there is shown an alternative slot arrangement similar to that as would be shown in FIG. 4. In this embodiment, it is envisaged that the thermostat has as many as three wing members. Further, the aperture would have a central portion 90 with three slots 92, 94, and 96 displaced evenly about the central aperture 90. To prevent the thermostat from pushing to far through the aperture, protrusions 98 located between each of the slots are provided.

I claim:

1. A thermostat mounting arrangement in an apparatus having a surface supporting portion with first and second opposing sides, the thermostat being mounted to engage the first and second opposing sides of the surface supporting portion to sense temperature conditions in the apparatus, the mounting arrangement comprising:

an aperture passing through the surface supporting portion, the aperture having an enlarged central opening with projection members extending into the central opening and at least two slots extending radially outward from the central opening of the aperture; and, the thermostat including a temperature sensitive surface portion adapted for positioning within the central opening of the aperture and at least two resilient wings each having an arm portion extending generally toward and through a corresponding slot of the aperture, each wing arm portion terminating in a bent end portion adapted to engage the first side of the surface portion adjacent the slot of the aperture when said each wing portion passes through said corresponding slot, and the thermostat being adapted to engage the second side of the projection members extending into the central opening of the aperture.

2. The apparatus of claim 1 wherein the temperature sensitive portion of the thermostat comprises a flat temperature responsive surface that is positioned slightly beyond the first surface of the surface supporting portion of the apparatus.

3. The apparatus of claim 2 wherein the thermostat further includes a depressed shoulder surrounding the temperature sensitive flat surface which is engaged by the projection members and allows the temperature sensitive flat surface to protrude slightly beyond the first side and into the apparatus.

4. The apparatus of claim 2 wherein the thermostat is inserted into the aperture by bending one of the resilient wing arms inwardly toward the thermostat to permit the insertion of the thermostat into the aperture until the depressed shoulder engages the second side of the projection members and the bent end portions of the wings engage the first side of the surface support portion adjacent the slots, and thereafter bending the one resilient wing outwardly such that the wing arms engage edges of the aperture.

5. The apparatus of claim 1 wherein the aperture comprises two diametrically opposed slots.

6. The apparatus of claim 5 wherein the projection members extending into the central opening each comprise two tab members having its second side engaging the thermostat.

7. The apparatus of claim 1 wherein the aperture comprises more than two slots displaced evenly about the central opening of the aperture.

8. The apparatus of claim 1 wherein the bent end portion comprises a flange.

9. The thermostat mounting arrangement of claim 1 wherein one of said two slots is longer than the other.

10. The thermostat mounting arrangement of claim 1 wherein one of said two slots is longer than the other.

11. A thermostat mounting arrangement in an apparatus having a surface supporting portion with first and second opposing sides, the thermostat being mounted to engage the first and second opposing sides of the surface supporting portion to sense temperature conditions in the apparatus, the mounting arrangement comprising:

an aperture passing through the surface supporting portion, the aperture having an enlarged central opening with projection members extending into the central opening and at least two slots extending radially outward from the central opening of the aperture; and, the thermostat including a temperature sensitive surface portion adapted for positioning within the central opening of the aperture and at least two resilient wing each having an arm portion extending generally toward and through a corresponding slot of the aperture, each wing arm portion terminating in a bent end portion adapted to engage the first side of the surface portion adjacent the slot of the aperture, and the thermostat being adapted to engage the second side of the projection members extending into the central opening of the aperture wherein air gaps are provided between the thermostat and the central opening of the aperture.

12. The apparatus of claim 11 wherein the air gaps on an upstream air flow side of the thermostat are sized differently from those on a downstream air flow side of the thermostat.

13. A thermostat mounting arrangement for use in a clothes dryer having a surface supporting portion having inner and outer opposing sides, the thermostat being mounted to engage the inner and outer opposing sides of the surface supporting portion to sense temperature conditions of an air stream adjacent the inner side of the surface supporting portion in the clothes dryer, the mounting arrangement comprising:

an aperture passing through the surface supporting portion, the aperture having an enlarged central opening with projection tab members extending into the central opening and two diametrically opposed slots extending radially outward from the central opening, and, the thermostat including a temperature sensitive flat surface adapted for positioning within the central opening of the aperture slightly beyond the inner surface of the surface supporting portion of the clothes dryer and two resilient wings each having an arm extending generally toward and through a corresponding slot of the aperture, each arm terminating in a bent end member adapted to engage the inner side of the surface portion adjacent the slot of the aperture, when said each arm passes through said corresponding slot, and the thermostat having a depressed shoulder surrounding the temperature sensitive flat surface which engages the outer side of the projection tab members extending into the central opening of the aperture.

14. The clothes dryer of claim 13 wherein the bent end portion comprises a flange having an open U-shape.

15. The clothes dryer of claim 13 wherein the thermostat is inserted into the aperture by bending one of the resilient wing arms inwardly toward the thermostat to permit the insertion of the thermostat into the aperture until the depressed shoulder engages the outer side of the projection members and the bent end portions of the wings engage the inner side of the surface support portion adjacent the slots and thereafter bending the one resilient wing outwardly such that the wing arms engage edges of the aperture.

16. The apparatus of claim 13 wherein air gaps are provided between the thermostat and the central opening of the aperture.

17. The apparatus of claim 16 wherein air gaps on an upstream air flow side of the thermostat are sized differently from those on a downstream air flow side of the thermostat.

* * * * *